US011377173B1

(12) United States Patent
Stanton

(10) Patent No.: US 11,377,173 B1
(45) Date of Patent: Jul. 5, 2022

(54) AUTOMATED COVER SUPPORT AND METHOD

(71) Applicant: Christopher T. Stanton, Stillwater, MN (US)

(72) Inventor: Christopher T. Stanton, Stillwater, MN (US)

( * ) Notice: Subject to any disclaimer, the term of this patent is extended or adjusted under 35 U.S.C. 154(b) by 0 days.

(21) Appl. No.: 16/941,086

(22) Filed: Jul. 28, 2020

Related U.S. Application Data

(60) Provisional application No. 62/880,299, filed on Jul. 30, 2019.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 3,105,931 | A | 10/1963 | Glassie et al. | |
| 3,698,409 | A | 10/1972 | Koontz et al. | |
| 4,683,901 | A | 8/1987 | Mitchell | |
| 5,479,872 | A * | 1/1996 | Hulett | B63B 17/02 114/361 |
| 6,308,653 | B1 | 10/2001 | Geraci | |
| 7,647,879 | B2 * | 1/2010 | del Valle Bravo | B63B 17/02 114/361 |
| 9,303,740 | B2 * | 4/2016 | Wu | F16H 25/20 |

* cited by examiner

*Primary Examiner* — Lars A Olson
(74) *Attorney, Agent, or Firm* — Kagan Binder, PLLC

(57) ABSTRACT

The invention relates to devices, systems, and methods that involve automatically lifting a boat cover above an interior of the boat.

16 Claims, 10 Drawing Sheets

PRODUCT FEATURES

- EASY TRIPOD DEPLOYMENT AND GRIP FEET ADD STABILITY ON BOAT SURFACE
- COMPACT DESIGN PROVIDES SPACE-SAVING STORAGE
- COLLAPSING LEG DESIGN PROVIDES PROTECTION FOR INNER COMPONENTS
- TELESCOPING SHAFT RAISES AND LOWERS TO QUICKLY AND EFFICIENTLY REACH A DESIRED HEIGHT
- VARIOUS END-CAPS ALLOW FOR CUSTOMIZATION TO A VARIETY OF BOAT COVER APPLICATIONS
- REMOVABLE AND RECHARGEABLE BATTERY

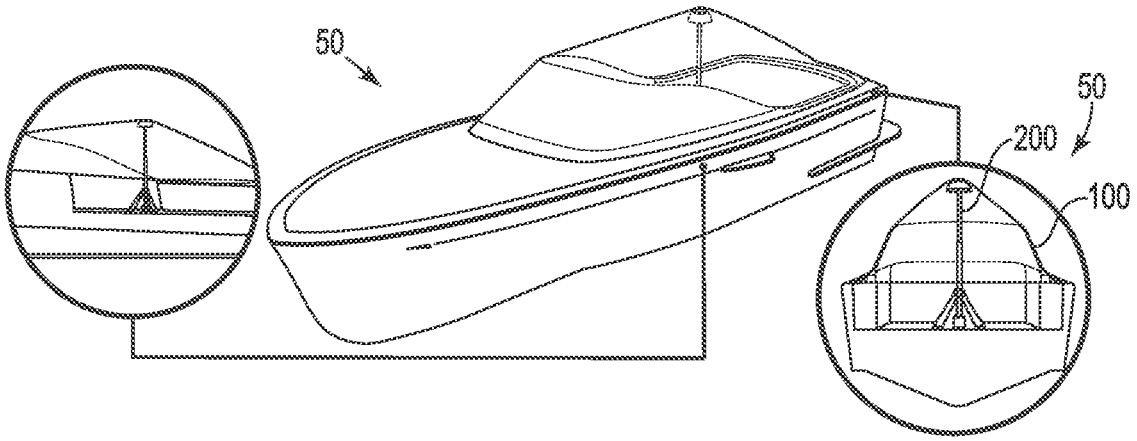

FIG. 6C

AUTOMATED COVER SUPPORT AND METHOD

PRIORITY CLAIM

This application claims the benefit of U.S. Provisional Application No. 62/880,299, filed Jul. 30, 2019, entitled "AUTOMATED COVER SUPPORT AND METHOD", the entire disclosure of which is incorporated herein by reference for all purposes.

FIELD

The invention relates to devices, systems, and methods that involve automatically lifting a boat cover.

BACKGROUND

A cover for a boat or other type of vehicle or structure will protect of the structure from elements such as rain, sun, wind, and debris, such as leaves, blowing dirt and sand, twigs, and bird droppings. The cover will be useful to protect a boat or other vehicle stored outdoors, or in an indoor storage facility.

Some boat cover designs, for use at an outdoor location, are held above the boat by a frame or other supporting structure, and may be incorporated into a dock or a boat lift that also supports and secures the boat in a position on a body of water. These boat covers may cover an entire boat. See, e.g., U.S. Pat. No. 4,683,901.

Other covers attach to a boat directly and enclose an "interior space" of the boat. Examples can enclose and protect a boat interior by attaching a perimeter of the cover to portions of the boat and then elevating the central region of the cover to produce an angled cover surface to cause water runoff See, e.g., U.S. Pat. Nos. 3,105,931, 3,698,409, and 6,308,653. With many of these boat cover designs, lifting the cover above the interior space requires the physically demanding and uncomfortable task of a person crawling beneath the cover of a sometimes hot and often constrained interior space of a boat to place vertical cover supports in the form of poles, beneath the cover to lift and support the cover from underneath.

Past cover supports are simple poles that may be of a fixed length, possibly telescoping, or possibly spring-loaded, that are placed with one end contacting and supporting the cover, and a second end supported by a fixed surface of the interior, such as a floor or deck, and remain essentially static (of a fixed length) after being positioned vertically to support the cover.

SUMMARY

The invention relates to method and devices useful for supporting a cover placed over an interior of a boat. In a boat with an interior and having a cover extending over the interior and secured at a perimeter of the interior, the interior contains an automated cover support located beneath the cover. The automated cover support includes an automated extendable pole that may be remotely actuated to cause the pole to extend from a non-extended position to an extended position to elevate the cover.

BRIEF DESCRIPTION OF THE DRAWINGS

FIGS. 6A, 6B, and 6C show examples of automated cover supports as described, and uses of automated cover supports at an interior of a covered boat.

Figure 1:
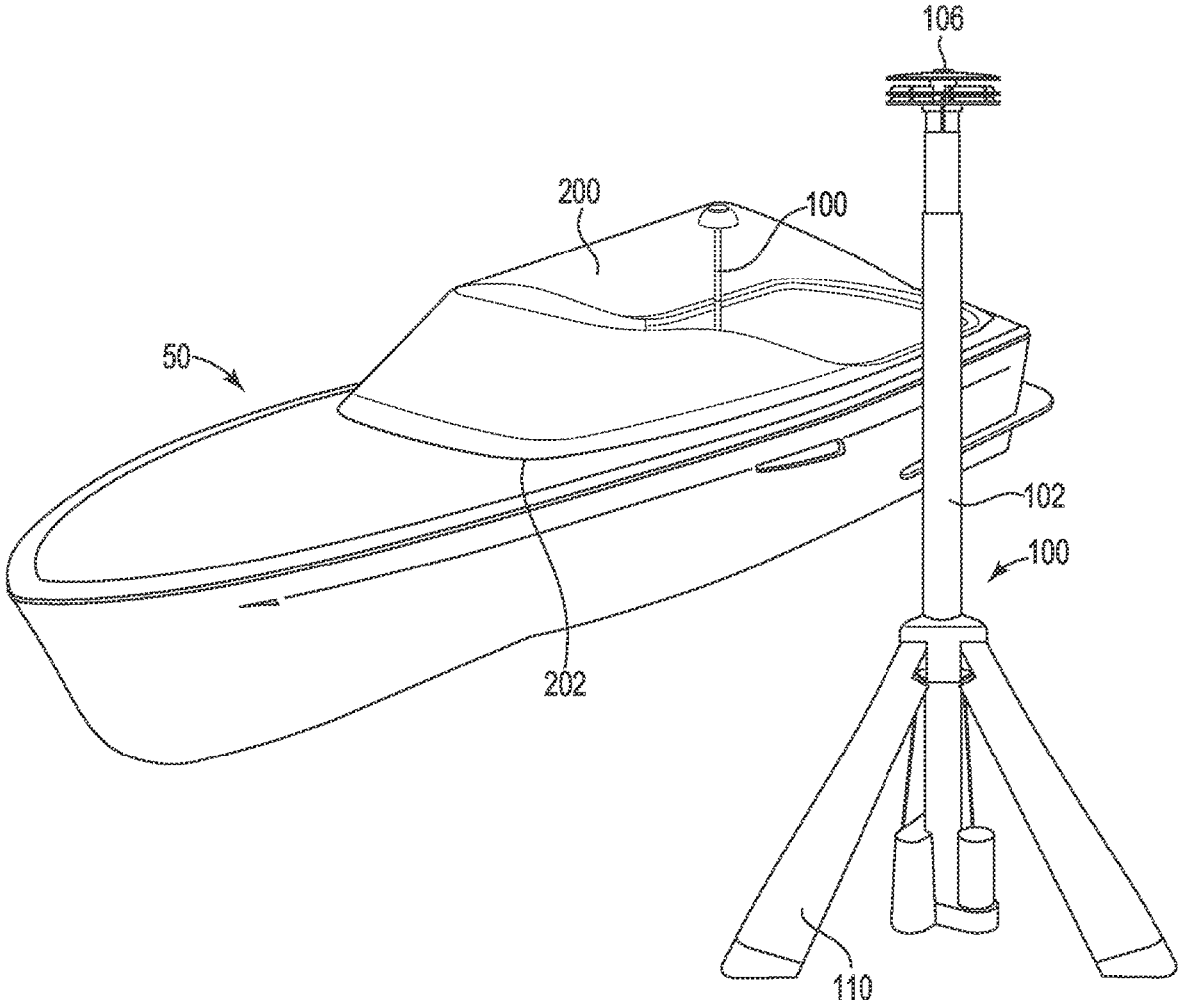
FIG. 1 illustrates an example of an example automated cover support, and use of the automated cover support at an interior of a boat to lift and support a cover.

All figures are schematic and not necessarily to scale.

DESCRIPTION

According to the present description, the Applicant has invented a novel device and method to make the job of elevating a boat cover easier to perform.

In one aspect, the invention relates to an automated cover support that includes a base and an automated extendable pole. The height of the automated pole can be increased or decreased remotely by a user. When the automated cover support is placed within an interior of a boat with the pole in a non-lengthened position, beneath a cover, the extendable pole can be extended and lengthened to increase the height of the pole and elevate the cover.

In another aspect, the invention relates to a method of using an automated cover support that includes a base and an automated extendable pole, to support a boat cover above a boat, e.g., to cover and enclose an interior portion of a boat. According to the method, a boat cover can be attached to surfaces of the boat to cover or enclose an interior space. The automated cover support can be placed below the cover, such as within the interior space. The height of the automated pole can be increased by a user, remotely, with the user standing near the boat and not being required to be beneath the cover or at the boat interior. With the automated cover support placed beneath the cover, e.g., within the boat interior and with the pole in a non-lengthened position, the extendable pole can be extended and lengthened to increase the height of the pole and elevate the cover.

With respect to the design of the device, the base may be of a fixed size and shape, or may be expandable in size. A fixed base can be of any shape, such as circular, square, or in the form of a tripod (e.g., triangular, pyramidal). An expandable base may be, for example, an expandable tripod (an expandable pyramid).

The extendable pole can include any automated extending mechanism such as a linear actuator. The linear actuator may be based on an electrical and mechanical mechanism effective to convert rotary motion of an electric motor into linear movement of an extendable pole. An example of a linear actuator may include an electric motor, an electric power source (e.g., a battery, which may be attached or remote), and a mechanical engagement between the motor and the extendable pole. Example mechanical engagements may include a threaded shaft of an extendable pole engaged with the motor through a gear (e.g., worm-gear, traveling-nut, rotating nut). Other linear actuators may be based on a hydraulic or pneumatic movement mechanism.

A cover that may be elevated and suspended over a boat to protect the boat may be made of any conventional boat cover material, such as canvas or plastic. The cover can be attached to surfaces of a boat in a manner to enclose an interior space of the boat. The cover may attach to the boat by use of any useful fastener such as a zipper or snap, etc. A boat "interior" can be considered to include a space of a boat that contains seats and possibly a steering wheel, dashboard, electronics, etc., for operating the boat. The interior may be defined at a perimeter by structures that include gunnels, a windshield, a bow, a stern, or fencing (such as in the case of a pontoon boat).

Referring to FIG. 1, boat 50 is shown with cover 200 attached at perimeter 202 to boat surfaces, and covering and enclosing an interior space and windshield of boat 50. Automated cover support 100 is shown as being located within the interior of boat 50 to support cover 200 from beneath. Automated cover support 100 includes pole 102 in an extended (lengthened) position so that cover 200 is supported in a manner to have angled upper surfaces that cause water to run off of the cover and not collect or form puddles on upper surfaces of cover 200.

Figures 2A, 2B, 2C:
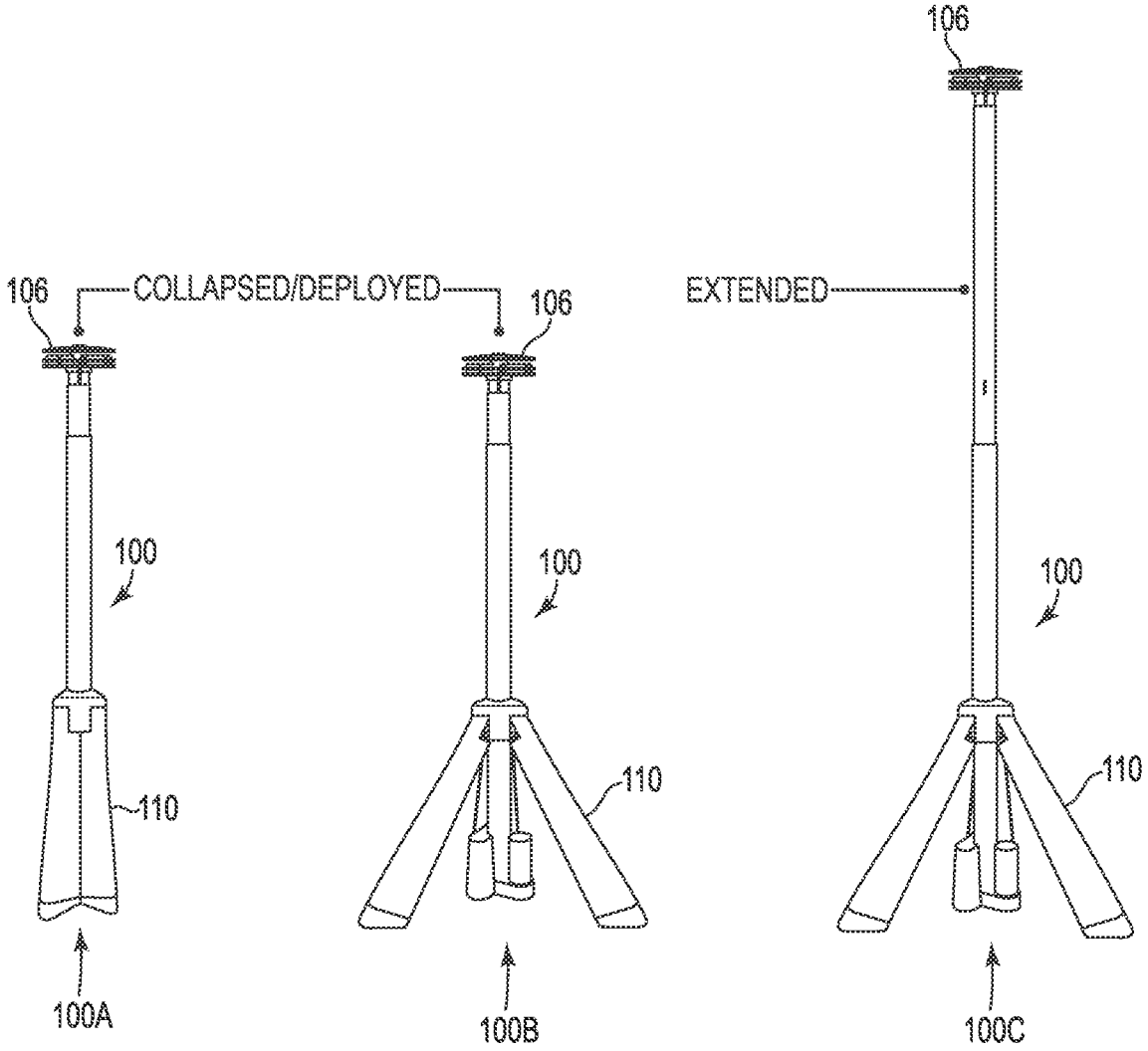
FIGS. 2A, 2B, 2C, 2D, 2E, 2F, and 2G show example automated cover supports and various example features thereof.
Figure 2D:
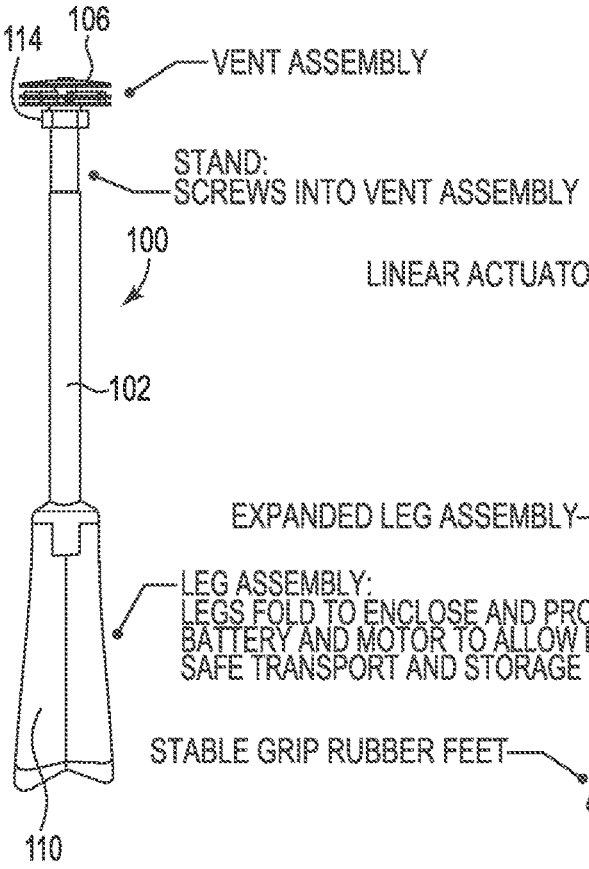

Referring now to FIG. 2A, automated support cover 100A is shown in a collapsed (non-lengthened, non-extended) state, and includes a collapsible tripod base 110 in a collapsed state. At FIG. 1B, collapsible tripod base 110 is expanded. At FIG. 1C, expandable tripod base 110 is expanded and extendable support pole 102 is extended.

In FIGS. 1, 2A, 2B, and 2C, stand 100 includes optional vent cap 106 that can be attached to and pass through a cover (e.g., 200) and allow air to circulate between a boat interior that is enclosed by a cover, and an exterior of the cover.

Figure 2E:
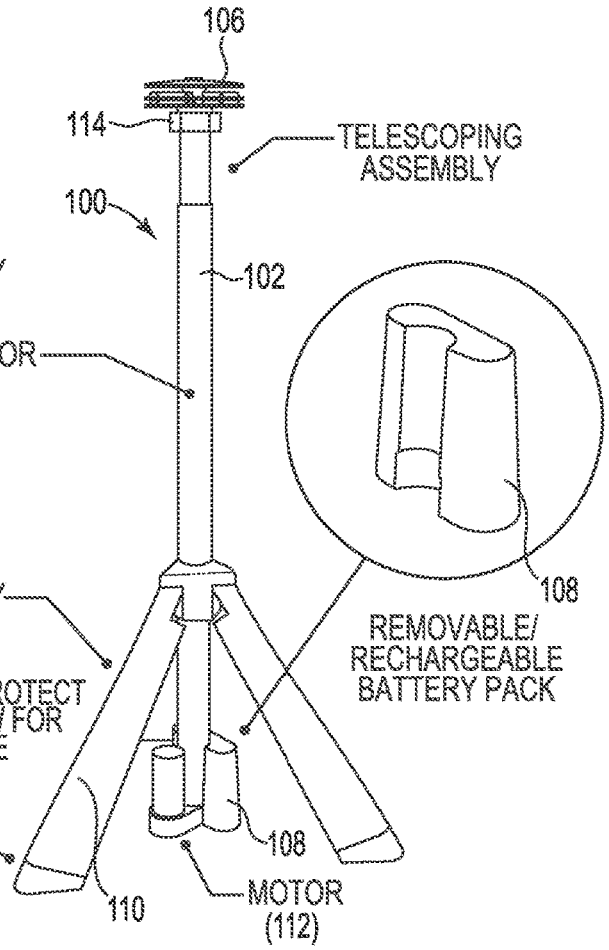
Figure 2F:
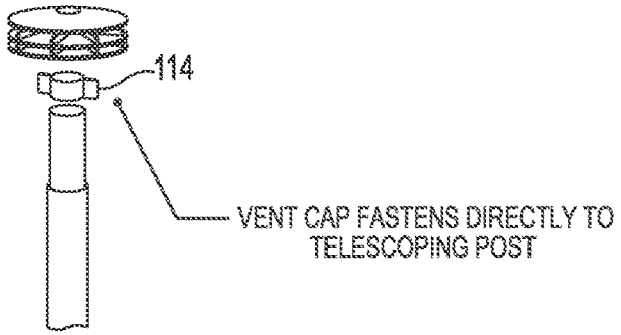
Figure 2G:
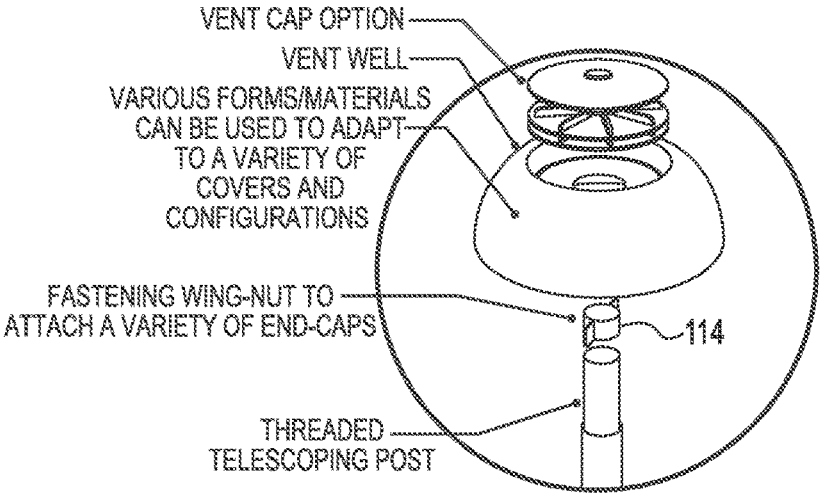

FIGS. 2D, 2E, 2F, and 2G show additional details of optional features of stand 100. At FIG. 2D, stand 100 includes an optional support 114 that can engage an upper end of extendable pole 102 while also engaging or supporting optional vent assembly 106, which is attached to a cover (not shown). FIG. 2F shows an exploded view of vent cap 106, pole 102, and support 114 (e.g., in the form of a threaded wing-nut), which engages a threaded end of extendable pole 102, as well as a vent cap or vent well. FIG. 2G shows details of an optional vent cap and vent well.

At FIG. 2E, stand 100 includes removable and rechargeable battery pack 108, for providing electric power to electric motor 112. Alternate power sources may also be used, such as a boat battery or an electrical power outlet.

Figure 3:
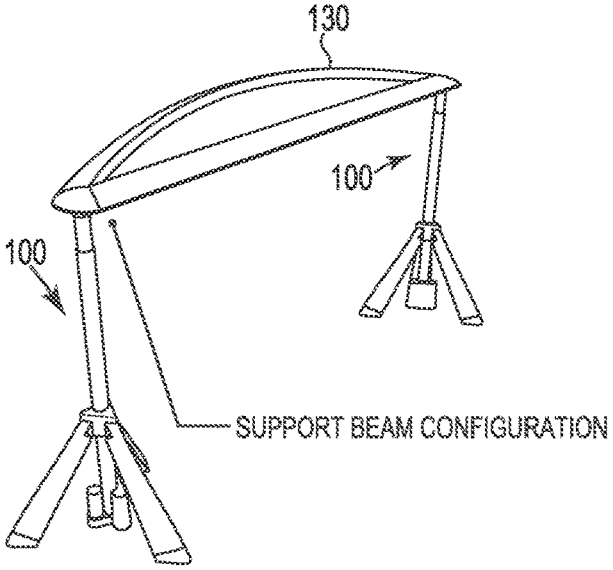
FIG. 3 shows an example of a combination of two automated cover supports used with a support beam.

FIG. 3 shows an example configuration of two stands 100 supporting opposite ends of frame 130. Frame 130 can be extended within an interior space of a boat and used to support a portion along a length or a width of a cover (now shown) from beneath the cover.

Figures 4A, 4B, 4C:
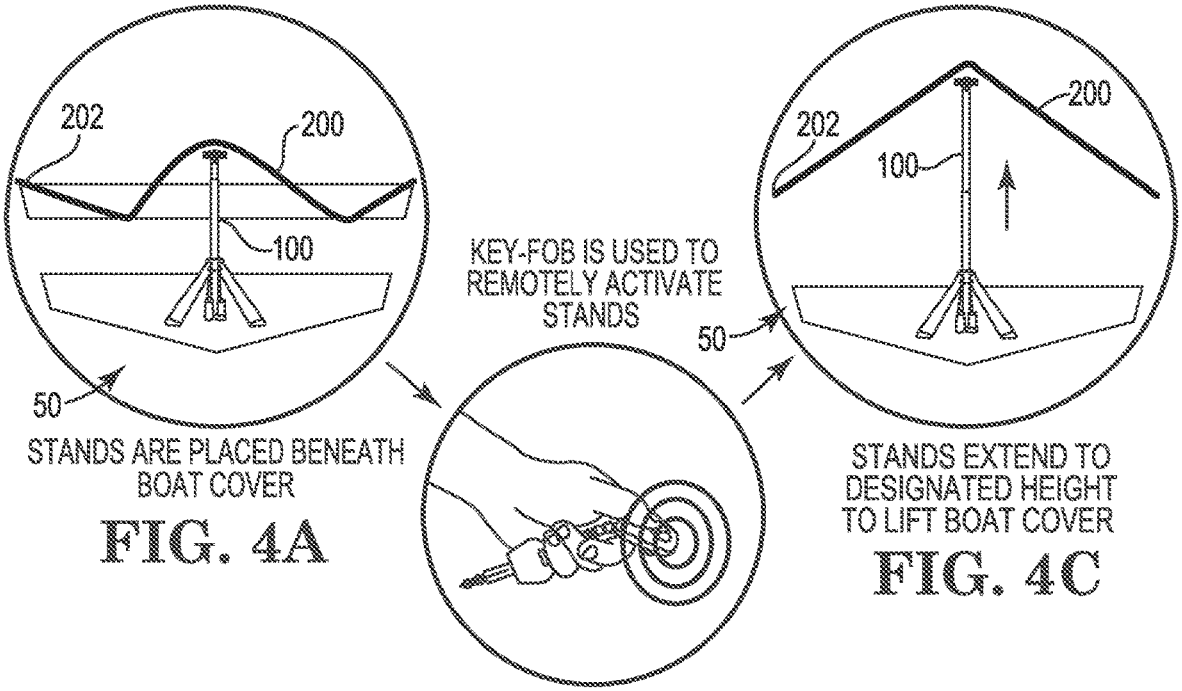
FIGS. 4A, 4B, and 4C show features of an example method as described.

FIGS. 4A, 4B, and 4C illustrate stand 100 in use in a method of lifting and supporting a boat cover over a boat interior. At FIG. 4A, stand 100 is shown located entirely within a boat (50) interior, e.g., with the base of the support positioned on a horizontal surface of the interior such as a floor, and with pole 102 initially in a non-extended (non-heightened) state. The stand (or multiple stands) can be first placed (e.g., entirely) within the boat interior space, and cover 200 can be subsequently placed over the interior and secured in position at perimeter 202. The cover will be substantially loose while pole 102 of stand 100 is located and oriented vertically below the cover, with an upper end of pole 102 optionally (typically) contacting a lower surface of the cover.

Once stand 100 is positioned with pole 102 substantially in a vertical orientation, the motor and extendable pole of stand 100 may be actuated remotely by an electronic actuator that generates and transmits an electromagnetic signal that is received by an electronic device of stand 100. As shown at FIG. 4B, the remote actuator such (electronic signal generator and transmitter) may be incorporated into a key fob. As shown at FIG. 4C, pole 102 of vertically-oriented stand 100 is lengthened to increase the height of the pole and to elevate cover 200 so that cover 200 takes a form that includes upper surfaces (e.g., as a tent or "tepee") that are angled to cause water to run off of the surfaces and prevent water from collecting as puddles on the upper exterior surface of the cover.

Figure 5:
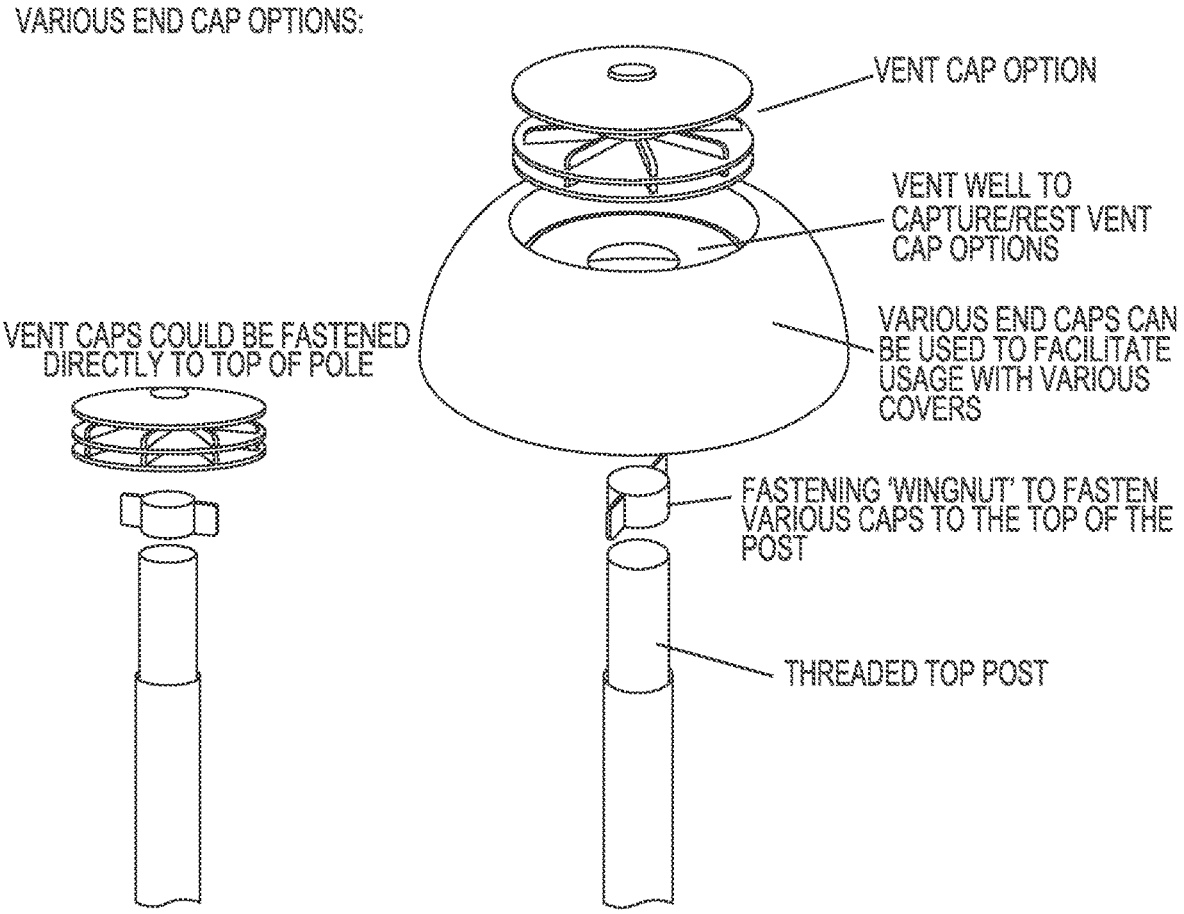
FIG. 5 shows example optional features of an end of a pole of an example automated cover support.

FIG. 5 includes enlarged illustrations of added details of structures of optional vent cap devices that can be removably engaged with an end of pole 102.

Figure 6A:
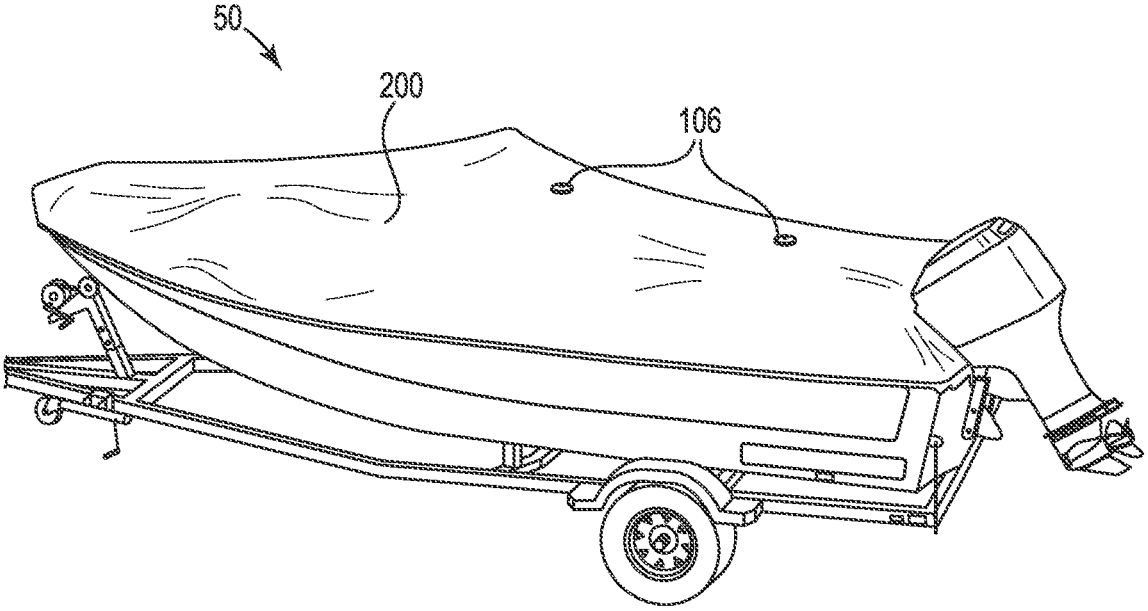
Figure 6B:
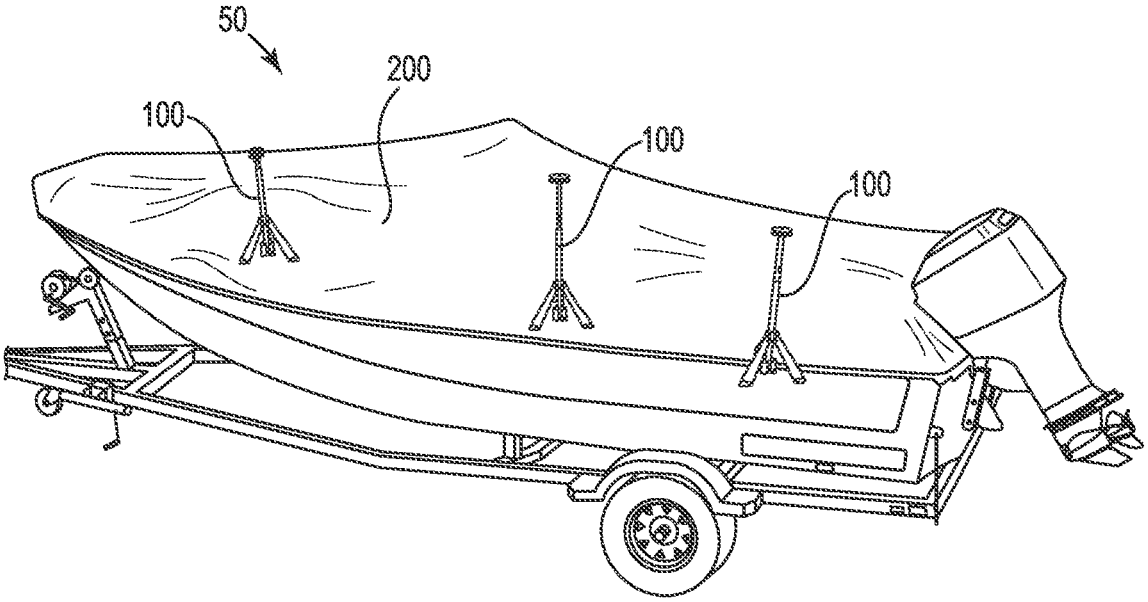

FIGS. 6A, 6B, and 6C are an exterior view of boat 50 with cover 200 supported by one or multiple stands 100 located at an interior space of the boat. Cover 50 may include vents 106 that are attached to the cover at locations to removably (temporarily) engage a support 114 attached to an end of a pole 102 of stand 100. In use, support 114 is caused to removably engage an opposed surface of vent 106. Alternately, a stand may include a soft rounded endcap (see FIG. 6C) that supports the cover or a beam structure.

Figure 7:
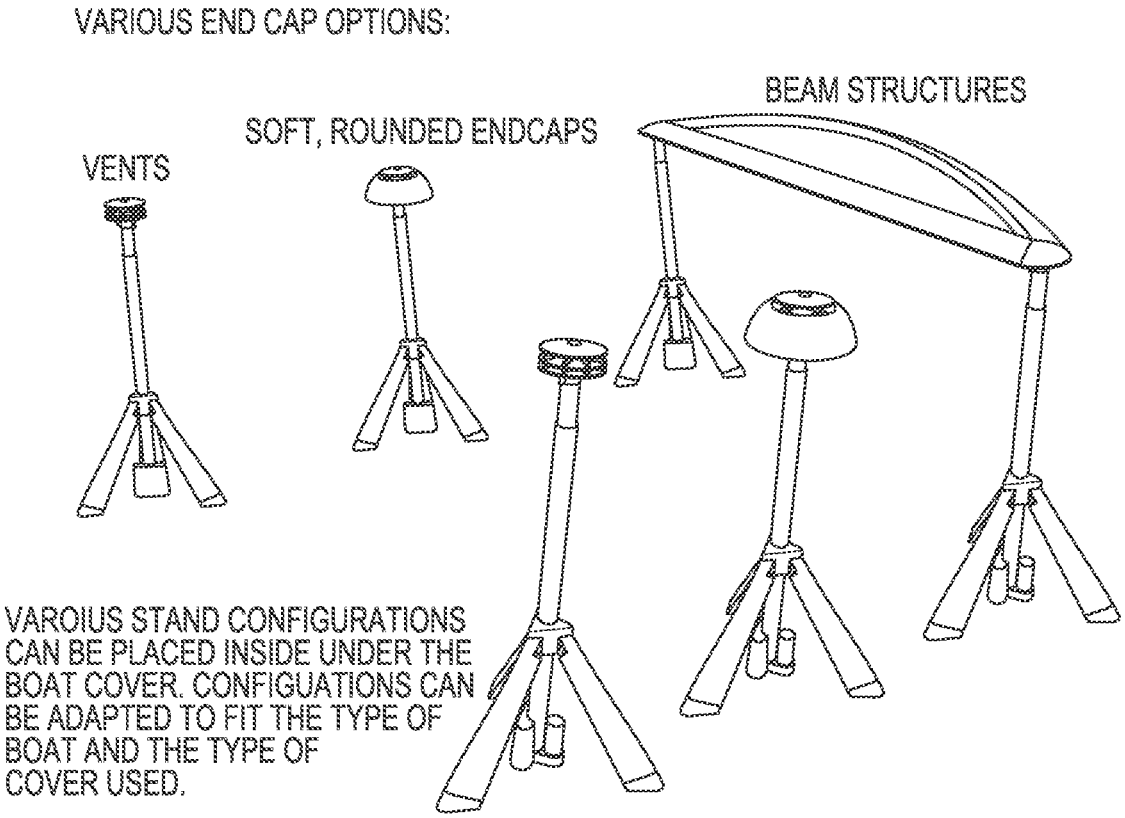
FIG. 7 shows example optional features of an end of a pole of an example automated cover support.

FIG. 7 shows a variety of different stand configurations that include end caps such as a vent, a rounded endcap (with a vent) and a beam or frame. Any of these or other end caps can be useful to provide additional support or a vent function to a cover supported by one or more stands as described.

According to a different variation of a stand as described, the stand can have a base that is built into a deck of flooring of a boat, and the pole in an un-extended position can be located below the deck. In use, the motor is activated and the pole automatically extends vertically from an opening in the floor. The stand is not portable but is permanently included in the structure of the boat. The stand can be powered by direct wiring to a boat battery and the floor opening may be covered by a removable or open-able lid to protect the top of the pole. In use, with the optional lid removed (or opened, etc.), the pole extends vertically from the level of the floor; when the pole retracts, when the height of the pole is reduced for cover removal, the pole retracts down entirely into the hole in the floor or deck.

The invention claimed is:

1. A method of supporting a cover placed over an interior of a boat, the method comprising: in a boat with an interior and having a cover extending over the interior and secured at a perimeter of the interior, the interior also containing an automated cover support that includes an automated extendable pole, remotely actuating the automated cover support pole to cause the pole to extend from a non-extended position to an extended position to elevate the cover, wherein the automated cover support is actuated remotely by an electronic actuator that generates and transmits an electromagnetic signal that is received by an electronic device of the automated cover support.

2. A method of claim 1 wherein the cover encloses the boat interior by attaching a perimeter of the cover to portions of the boat, and the elevated cover is elevated at a central region of the cover to produce an angled cover surface above the boat interior.

3. The method of claim 1 wherein the automated cover support comprises a base and the extendable pole, the automated cover support is moveable relative to the interior, and the method comprises placing the automated cover support at a surface of the interior beneath the cover and then remotely actuating the pole.

4. The method of claim 3 wherein the method comprises:

placing the automated cover support at a surface of the interior, then placing the cover over the automated cover support and securing the cover at a perimeter of the interior, then actuating the pole to cause the pole to extend from a non-extended position to an extended position to elevate the cover.

5. The method of claim 1 wherein the automated cover support comprises a base and a linear actuator that is adapted to move the pole between the non-extended position and the extended position.

6. The method of claim 1 wherein the electronic actuator comprises a key-fob.

7. The method of claim 1 wherein the automated cover support comprises a rechargeable battery.

8. The method of claim 7 wherein the electronic actuator comprises a key-fob.

9. The method of claim 1 wherein the automated cover support comprises a fixed size base.

10. The method of claim 1 wherein the automated cover support comprises an expandable base.

11. The method of claim 1 wherein the automated cover support comprises an expandable tripod base.

12. The method of claim 1 wherein the automated cover support comprises a folding leg assembly.

13. The method of claim 12 wherein the automated cover support comprises a rechargeable battery.

14. The method of claim 1 wherein:

the automated cover support comprises:

an expandable tripod base, a linear actuator that is adapted to move the pole between the non-extended position and the extended position, and a rechargeable battery, and the electronic actuator comprises a key-fob.

15. The method of claim 1 wherein the automated cover support comprises a base that is built into a deck of the boat.

16. The method of claim 15 wherein the electronic actuator comprises a key-fob.

* * * * *